US009204770B2

(12) United States Patent
Worker et al.

(10) Patent No.: US 9,204,770 B2
(45) Date of Patent: Dec. 8, 2015

(54) CLEANER HEAD FOR A CLEANING APPLIANCE

(75) Inventors: David Colin Worker, Wiltshire (GB); James Dyson, Gloucestershire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 1532 days.

(21) Appl. No.: 11/794,980

(22) PCT Filed: Dec. 28, 2005

(86) PCT No.: PCT/GB2005/005107

§ 371 (c)(1),
(2), (4) Date: May 2, 2008

(87) PCT Pub. No.: WO2006/077373

PCT Pub. Date: Jul. 27, 2006

(65) Prior Publication Data

US 2008/0222840 A1 Sep. 18, 2008

(30) Foreign Application Priority Data

Jan. 18, 2005 (GB) ..... 0500982.4

(51) Int. Cl.

| | |
|---|---|
| ***A47L 9/02*** | (2006.01) |
| ***A47L 9/04*** | (2006.01) |
| ***A47L 7/00*** | (2006.01) |
| *A47L 11/40* | (2006.01) |

(52) U.S. Cl.

CPC ..... *A47L 9/04* (2013.01); *A47L 7/0019* (2013.01); *A47L 9/02* (2013.01); *A47L 11/4041* (2013.01)

(58) Field of Classification Search

CPC ..... A47L 9/02; A47L 9/04; A47L 7/0019; A47L 11/4041

USPC ..... 15/415.1, 383

See application file for complete search history.

(56) References Cited

U.S. PATENT DOCUMENTS 2,622,263 A * 12/1952 Allen ..... 15/325
5,652,996 A 8/1997 Moine et al.

(Continued)

FOREIGN PATENT DOCUMENTS

| | | |
|---|---|---|
| DE | 195 47 311 | 6/1997 |
| EP | 0 426 534 | 5/1991 |

(Continued)

OTHER PUBLICATIONS

JP Office Action issued Sep. 1, 2009 in corresponding JP Patent Application No. 2007-550828 with English language translation (6 pages).

*Primary Examiner* — Bryan R Muller
(74) *Attorney, Agent, or Firm* — Morrison & Foerster LLP

(57) ABSTRACT

A cleaner head for a cleaning appliance includes a housing having an upper surface and an underneath surface in which at least on suction opening is formed. The underneath surface has opposing side edges each having a first part which lies adjacent the suction opening or openings and forms a sharply-defined edge with the upper surface and an upwardly curved second part which is located rearwardly of the suction opening or openings. This arrangement is advantageously used in vacuum cleaners or other cleaning appliances in which a ball-type support allows an increased level of steerability involving lateral movement of the cleaner head across the surface to be cleaned. The upwardly curved side edges of the underneath surface of the cleaner head reduce the amount of effort required to achieve the steering by presenting a smoothly curved surface to the carpet or other floor covering.

18 Claims, 6 Drawing Sheets

(56) References Cited

U.S. PATENT DOCUMENTS

| | | | |
|---|---|---|---|
| 6,101,668 | A | 8/2000 | Grey |
| 6,385,811 | B1 | 5/2002 | Dilger et al. |

FOREIGN PATENT DOCUMENTS

| | | | | |
|---|---|---|---|---|
| GB | 509528 | | | 7/1939 |
| GB | 2 391 459 | | | 2/2004 |
| GB | 2391459 | A | * | 2/2004 |
| JP | 05-084178 | | | 4/1993 |
| JP | 06-165743 | | | 6/1994 |
| JP | 06165743 | A | * | 6/1994 |
| JP | 2000-126098 | | | 5/2000 |
| JP | 2004-230031 | | | 8/2004 |
| JP | 2004230031 | A | * | 8/2004 |
| WO | WO 2004/014209 | | | 2/2004 |

* cited by examiner

CLEANER HEAD FOR A CLEANING APPLIANCE

REFERENCE TO RELATED APPLICATIONS

This application is a national stage application under 35 USC 371 of International Application No. PCT/GB2005/005107, filed Dec. 28, 2005, which claims the priority of United Kingdom Application No. 0500982.4, filed Jan. 18, 2005, the contents of both of which prior applications are incorporated herein by reference.

FIELD OF THE INVENTION

The invention relates to a cleaner head for a cleaning appliance, particularly but not exclusively to a cleaner head for a vacuum cleaner. The invention is applicable equally to a cleaner head for an upright vacuum cleaner or a cylinder vacuum cleaner.

BACKGROUND OF THE INVENTION

Vacuum cleaners are now emerging onto the market which have a greater degree of steerability than has previously been the norm. In particular, upright vacuum cleaners which are supported and steered on ball-type rolling members are becoming available, as are cylinder vacuum cleaners which have cleaner heads having ball-type supports to improve maneuverability. In some of these arrangements, the act of steering the cleaner head so that it adopts a new direction of movement may cause the cleaner head to travel over the surface being cleaned in a lateral direction in comparison to the normal direction of travel. In these circumstances, the cleaner head can dig into the floor covering, particularly carpets, which increases the effort required successfully to carry out the steering manoeuvre.

This problem can be reduced by providing curved side edges on a cleaner head. GB 509,528 discloses a vacuum cleaner head which has smoothly rounded lower edges. However, all of the lower edges of the vacuum cleaner head are smoothly rounded which prevents the cleaner head from cleaning effectively at the edges of a room, for example, adjacent to a skirting board.

SUMMARY OF THE INVENTION

It is an object of the present invention to reduce the amount of turning force required to achieve a change in direction of a vacuum cleaner having ball-type steering mechanism whilst still maintaining cleaning performance at the edges of a room. Another object of the invention is to improve the maneuverability of vacuum cleaners of the type described above.

The invention provides a cleaner head for a cleaning appliance comprising a housing having an upper surface and an underneath surface in which at least one suction opening is arranged, the underneath surface having opposing side edges, each side edge comprising a first part which lies adjacent the suction opening or openings and forms a sharply-defined edge with the upper surface and a second part which is located rearwardly of the suction opening or openings and is upwardly curved, characterized in that the cleaner head has a plurality of rearwardly extending portions, each rearwardly extending portion having opposing side edges which are upwardly curved.

The provision of sharply-defined side edges which lie adjacent the suction opening allows the side wall of the housing adjacent the suction opening to be as slim as possible so that the ability of the cleaner head to pick up dirt and debris from areas close to walls and skirting boards is maximized.

Further, it has been found by empirical testing that it is the rearmost part of the cleaner head which is most prone to digging into carpets and other fabric floor coverings when the cleaner head moves laterally over the floor surface. The provision of upwardly curved side edges rearwardly of the suction opening or openings allows the cleaner head to present a smoothly rounded face to the floor surface being cleaned as it moves laterally across the floor. The possibility of the cleaner head digging into a carpet or other fabric floor covering is thus reduced. This in turn allows the cleaner head to move across the floor surface more smoothly than has previously been possible so that steering of the vacuum cleaner requires less effort than would otherwise be the case.

By providing each rearwardly extending portion with upwardly curved opposing side edges, it is ensured that all of the side edges rearwardly of the suction opening present a smoothly rounded surface to the floor covering so as to smooth the lateral movement of the cleaner head across the surface to be cleaned.

Preferably, the second part of each of the side edges extends along less than one half of the full length of the respective side edge.

Preferably, one rearwardly extending portion is located at each side of the cleaner head so that one side edge of each rearwardly extending portion forms the second part of each side edge.

In a preferred embodiment, the upwardly curved second part of each side edge extends to a height of at least one quarter, preferably at least one third, of the rearmost height of the housing. This feature enhances the performance of the cleaner head according to the invention when used on deep pile carpets.

As has been mentioned above, the cleaner head of the invention is particularly effective when it is used in combination with an upright vacuum cleaner and the upright vacuum cleaner is carried by a rolling support member having an arcuate surface. In these circumstances, the arrangement is such that, when in use the upright vacuum cleaner is caused to turn, the cleaner head travels laterally across the floor surface. The side edges rearwardly of the suction opening then present a smoothly rounded surface to the floor surface and the lateral movement of the cleaner head requires little or no additional effort on the part of the user.

BRIEF DESCRIPTION OF THE DRAWINGS

An embodiment of the invention will now be described with reference to the accompanying drawings, wherein.

DETAILED DESCRIPTION OF THE INVENTION

Figure 1A:
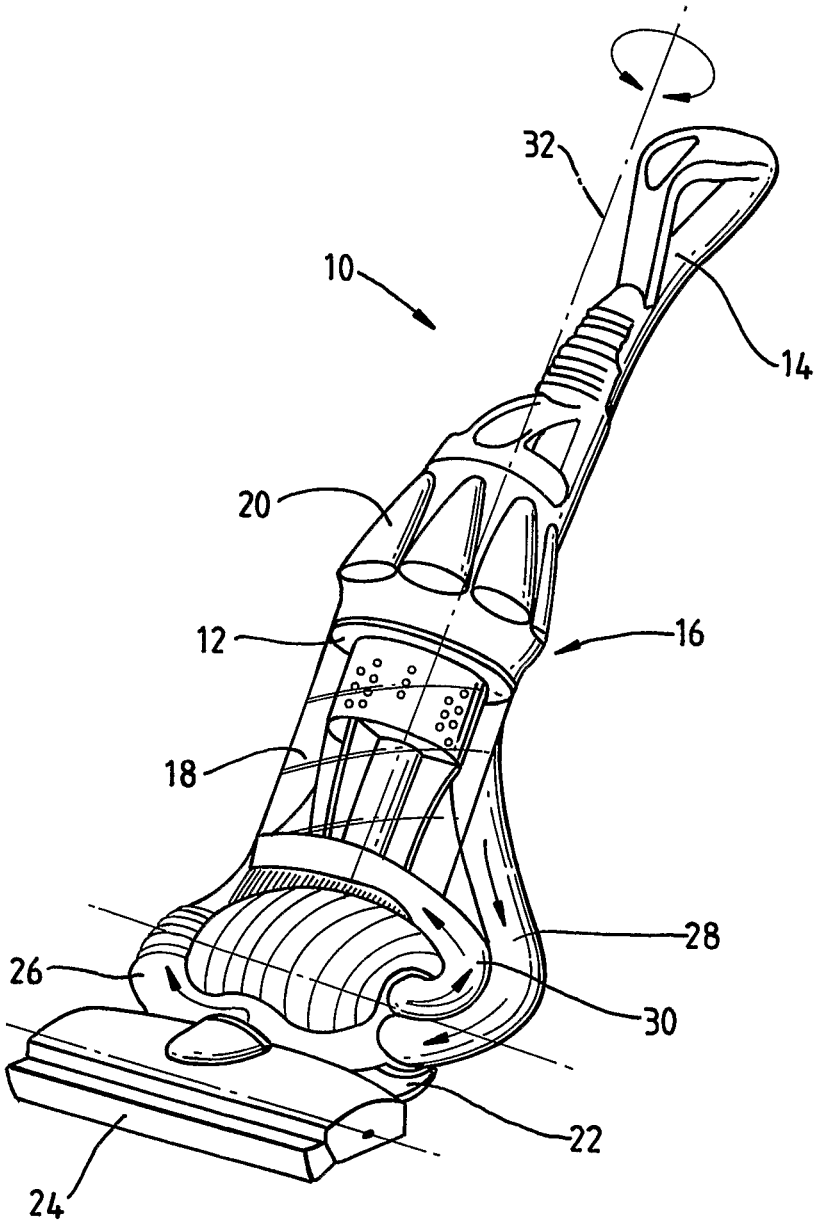
FIGS. 1*a* and 1*b* illustrate known upright and cylinder cleaners respectively in which the invention may be utilized.

The vacuum cleaner 10 illustrated in FIG. 1*a* is an upright cleaner having a main body 12 which includes a handle 14 and dirt and dust separating means 16 for separating dirt and dust from the airflow passing through the vacuum cleaner 10. In the vacuum cleaner 10, the dirt and dust separating means 16 operates on the cyclonic principle and includes an upstream, low-efficiency cyclone 18 followed by a plurality of downstream, high-efficiency cyclones 20. However, for the purposes of the present invention, the nature of the dirt and dust separating means 16 is immaterial.

The main body 12 is pivotably supported on a rolling support member 22 which has an arcuate surface when viewed in the lateral direction. A cleaner head 24 is pivotably mounted on the support member 22 and air ducts 26, 28, 30 are provided for conducting air between the cleaner head 24, the support member 22 and the dirt and dust separating apparatus 16. A motor (not shown) is mounted inside the support member 22 for drawing an airflow into the cleaner head 24 via a suction opening (located on the underside of the cleaner head 24), passing it to the dirt and dust separating apparatus 16 so that the dirt and dust can be extracted therefrom, and exhausting it to the atmosphere via the support member 22 so that the motor therein can be cooled. It is to be noted that the precise configuration of the components is not material to the present invention.

Figure 2B:
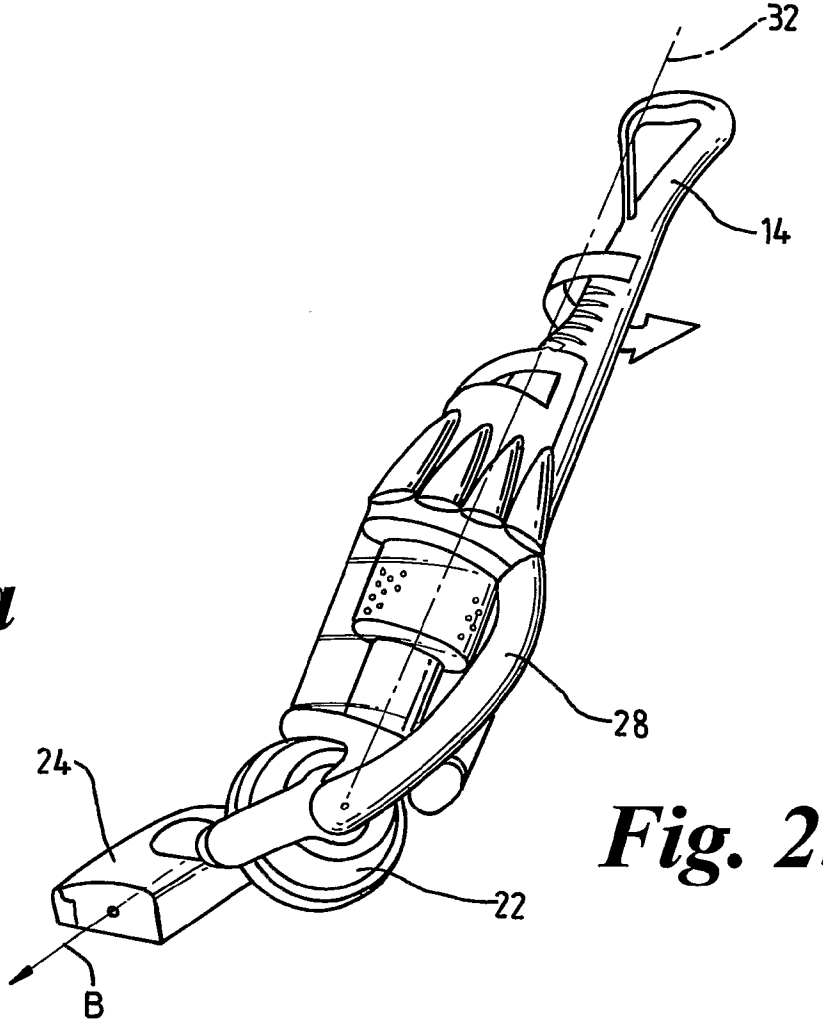
FIGS. 2*a* and 2*b* illustrate the manner in which the upright cleaner of FIG. 1*a* is steered.
Figure 2A:
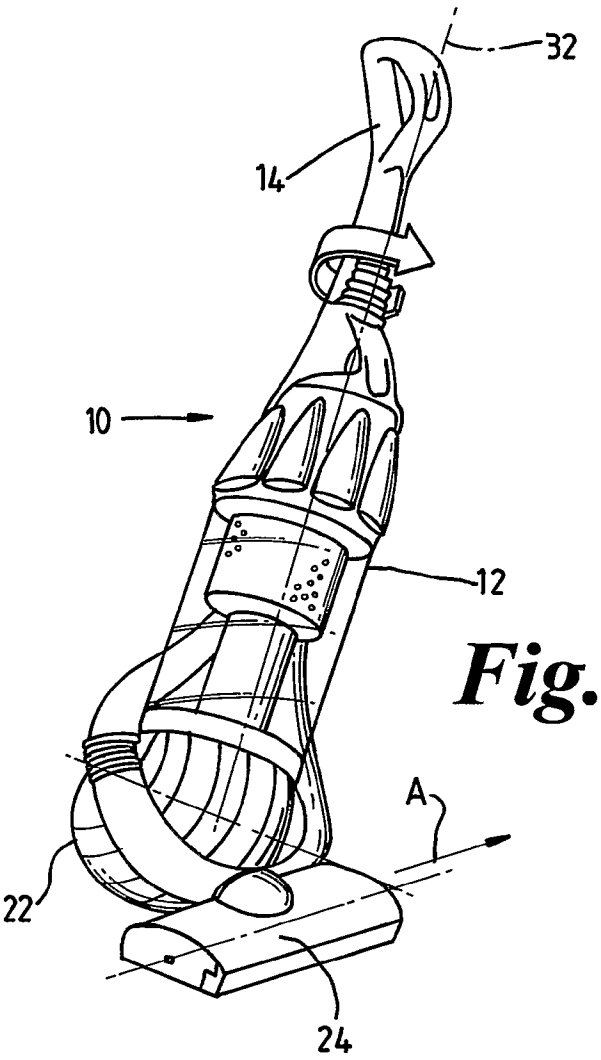
Figure 3:
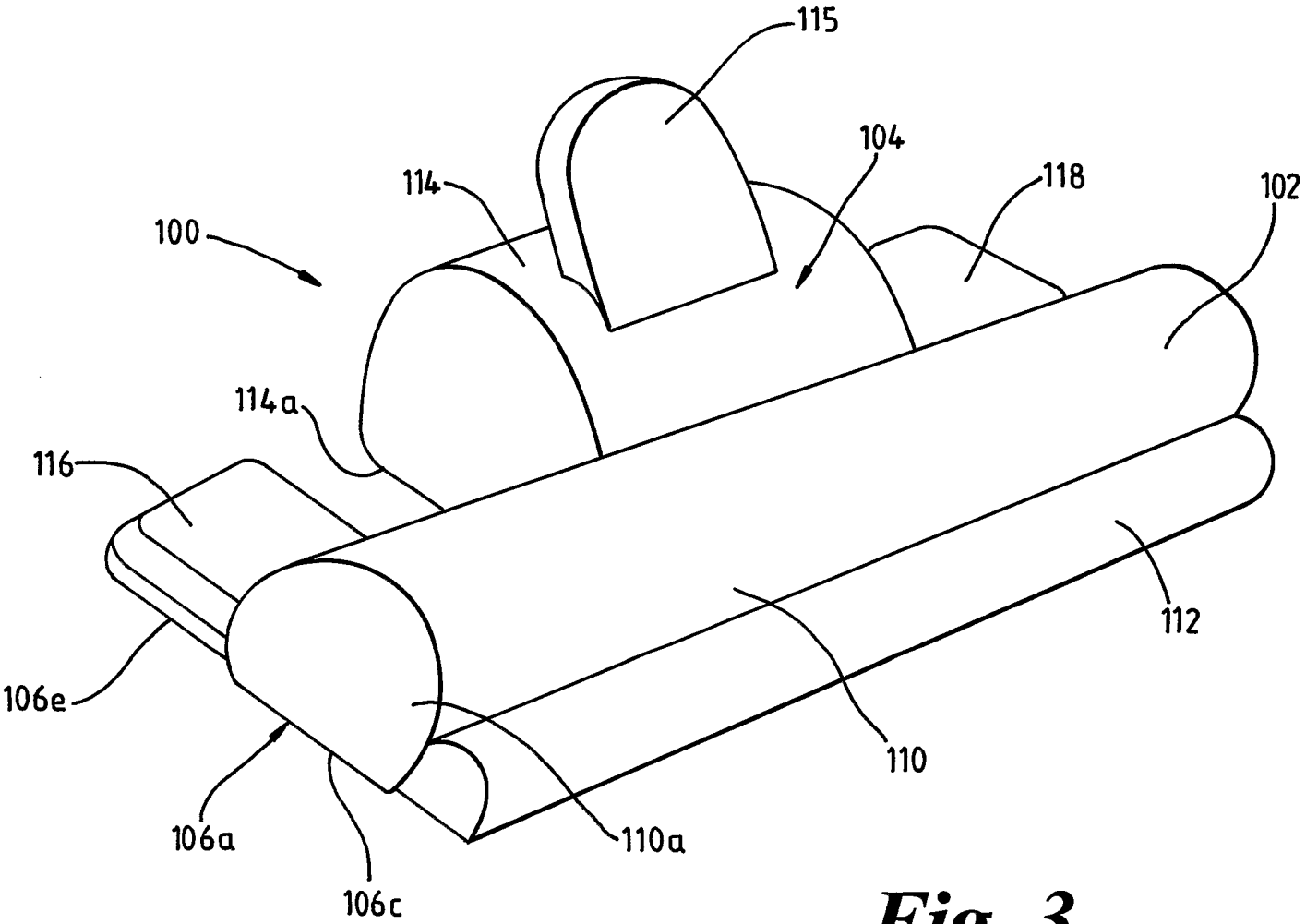
FIG. 3 is a perspective view of a cleaner head according to the present invention.
Figure 4A:
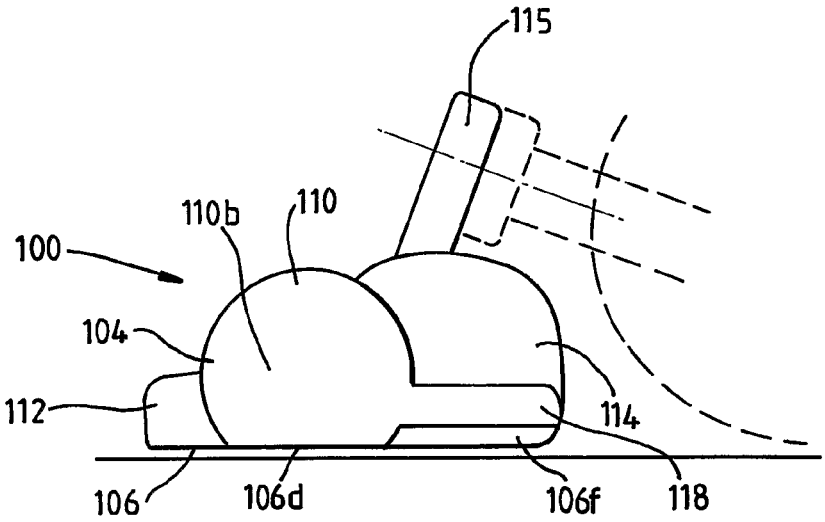
FIGS. 4*a*, 4*b* and 4*c* are side, top and front views respectively of the cleaner head of FIG. 3.
Figure 4B:
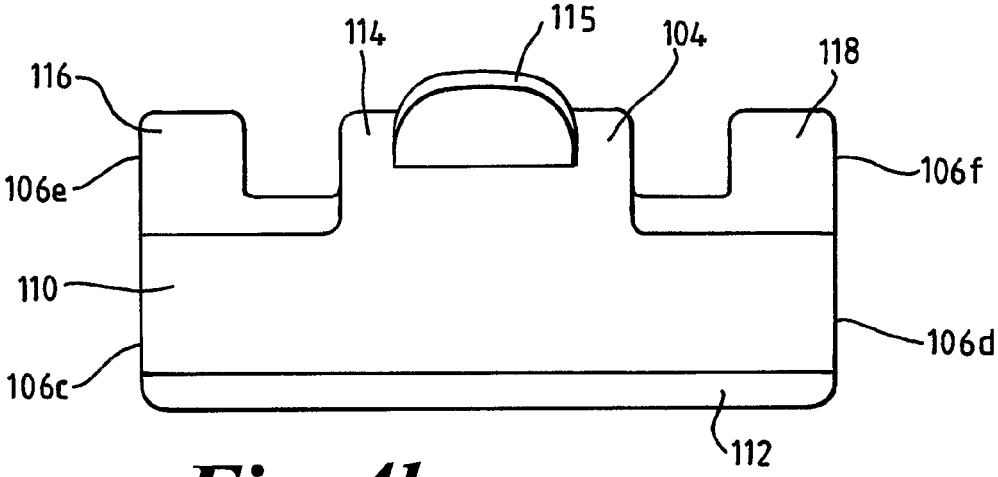
Figure 4C:
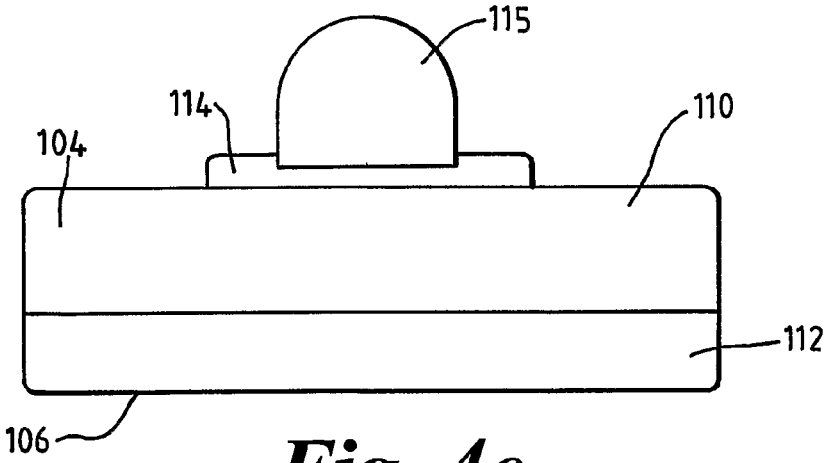

The type of support member 22 illustrated in FIG. 1*a* allows the upright vacuum cleaner 10 to be maneuvered in a manner which is different from traditional vacuum cleaners which are normally mounted on wheels having fixed horizontal axes. The manner in which the vacuum cleaner 10 is maneuvered is illustrated in FIGS. 2*a* and 2*b*. In order to steer the vacuum cleaner 10, the user twists the handle 14 about the axis 32 so as to cause the axis of the support member 22 to tilt. The connection between the cleaner head 24 and the air duct 26 (which is fixed to the main body 12) is such that the cleaner head 24 is forced to travel laterally with respect to the normal forwards direction of travel of the cleaner head 24. Thus the cleaner head 24 moves in the direction indicated by arrow A in FIG. 2*a* and arrow B in FIG. 2*b* when it is steered around tight corners.

Figure 1B:
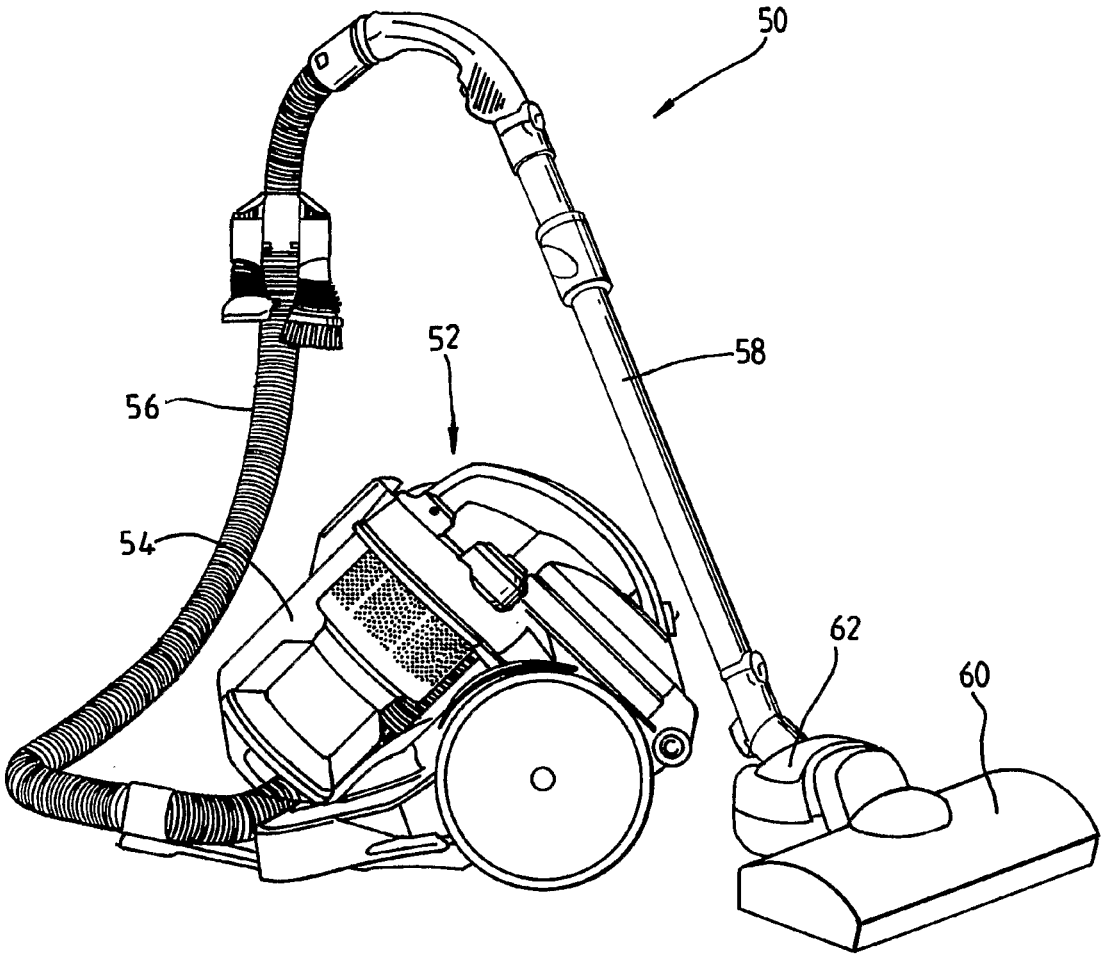

A similar arrangement is possible in respect of cylinder vacuum cleaners. A cylinder vacuum cleaner 50 is shown in FIG. 1*b*. The cleaner 50 has a main body 52 which includes some sort of dirt and dust separating means 54 (again shown here as being cyclonic, but this is not important) and a motor. A flexible hose 56 is connected to the main body 52 at one end and to a wand or extension tube 58 at the other end. The cleaner head 60 is attached to the distal end of the wand or extension tube 58. As with the upright cleaner illustrated in FIG. 1*a*, the cleaner head 60 can be attached to the extension tube 58 using the same principles, namely by providing an arcuate support member 62 whose axis of rotation can be tilted by twisting the extension tube 58 about its longitudinal axis. The connection between the cleaner head 60 and the extension tube 58 then causes the direction of the cleaner head 60 to alter which, in turn, causes the cleaner head 60 to travel laterally with respect to the original forward direction.

It is this lateral movement across the surface being cleaned which can introduce difficulties in that unnecessary resistance can be encountered making the required movement difficult to achieve.

Figure 5A:
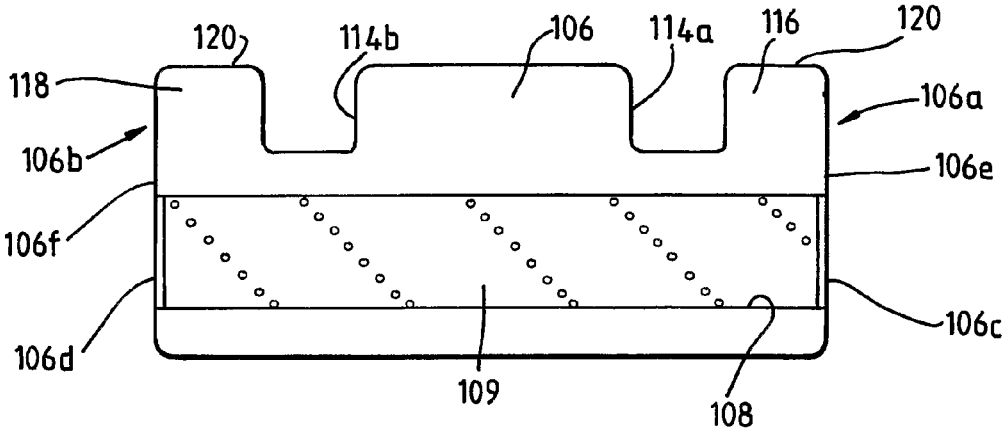
FIGS. 5*a* and 5*b* are underneath and rear views respectively of the cleaner head of FIG. 3.

A cleaner head 100 according to the invention is illustrated in FIGS. 3, 4*a*, 4*b*, 4*c*, 5*a* and 5*b*. The cleaner head 100 has a housing 102 which has an upper surface 104 and an underneath surface 106. The upper surface 104 and the underneath surface 106 together define the housing 102. The underneath surface 106, which can be seen in FIG. 5*a*, is arranged to face towards the surface to be cleaned and has a suction opening 108 formed therein. The suction opening 108 extends across substantially the entire width of the cleaner head 100.

The upper surface 104 has an enlarged, generally cylindrical portion 110 extending across the width of the cleaner head 100 and arranged above the suction opening 108 in the underneath surface 106. This cylindrical portion 110 defines a cavity which is shaped and dimensioned so as to be able to receive and house a rotatable brush bar 109 immediately above the suction opening 108. Side walls 110*a*, 110*b* are located at the ends of the cylindrical portion 110. The suction opening 108 extends between the side walls 110*a*, 110*b*. The side walls 110*a*, 110*b* are substantially flat or planar so that the suction opening 108 of the cleaner head 100 is as close as possible to the side of the cleaner head 100. When the side of the cleaner head 100 is positioned close to walls or skirting boards in a room, the collection of dirt and dust from the edge of the room is improved because the suction opening 108 is spaced from the wall or skirting board by only the thickness of the respective side wall 110*a*, 110*b*.

The underneath surface 106 has opposing side edges 106*a*, 106*b* which extend along the lower edges of the sides of the cleaner head 100. A first part 106*c*, 106*d* of each side edge 106*a*, 106*b* of the underneath surface 106 is formed by the lower end of the respective side wall 110*a*, 110*b*. The lower ends of the side walls 110*a*, 110*b* extend alongside the suction opening 108 and have sharply-defined edges which delimit the suction opening 108. By sharply-defined is meant that the edges are angular and have a minimal radius of curvature.

A second part 106*e*, 106*f* of each of the side edges 106*a*, 106*b* is located rearwardly of the first parts 106*c*, 106*d*. The second part 106*e*, 106*f* of each of the side edges 106*a*, 106*b* of the underneath surface 106 is upwardly curved. By this is meant that the underneath surface 106 is shaped so that, instead of the underneath surface 106 meeting the upper surface 104 at a relatively sharp corner, the upwardly curved second part 106*e*, 106*f* of each the side edges 106*a*, 106*b* presents a smoothly curved surface to the floor surface being cleaned.

It will be understood that, when the cleaner head 100 is steered so that some lateral movement takes place, then the upwardly curved shape of the second part of the side edge on the side facing the direction of lateral movement will present a smoothly curved surface to the floor being cleaned. This will reduce the amount of user effort required to cause the lateral movement to take place since the floor covering will slide smoothly underneath the cleaner head 100 and the tendency of the cleaner head 100 to dig into the floor covering will be reduced. At the same time, the first part of each side edge can be placed close to a wall or skirting board so that good edge cleaning is maintained.

Figure 5B:
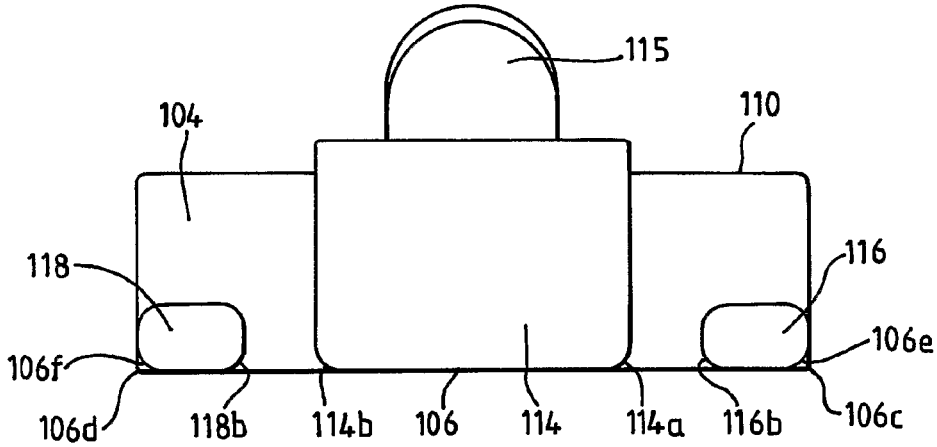

The upward curve of the underneath surface 106 is shown in FIG. 5*b*. As can be seen, the shape of the second part 106*e*, 106*f* of each of the side edges 106*a*, 106*b* is rounded with a relatively large radius of curvature compared to the first parts 106*c*, 106*d*. The upwardly curved second parts 106*e*, 106*f* of the side edges 106*a*, 106*b* do not extend alongside the suction opening 108 as this could compromise the ability of the cleaner head 100 to pick up dirt and debris adjacent an edge or skirting board. In this embodiment, the upwardly curved second parts 106*e*, 106*f* extend along less than a half of the full length of the side edges 106*a*, 106*b* as can be seen in FIG. 5*a*.

Immediately in front of the cylindrical portion 110 is a bumper portion 112 which forms part of the upper surface 104. A debris pick-up slot can be formed immediately behind the bumper portion 112 but this is not relevant to the present invention. Rollers or wheels (not shown) can be provided on the underneath surface 106 adjacent the bumper strip to improve the forward movement of the cleaner head 100 across the surface to be cleaned.

The upper surface 104 of the housing 102 is shaped so as to define, together with a portion of the underneath surface 106, a motor housing 114 which is located centrally of the cleaner head 100 behind the cylindrical portion 110. A motor (not shown) for driving the brush bar 109 is housed inside the motor housing 114 and an appropriate drive belt or direct drive components are provided between the motor and the brush bar 109. Located on the upper surface of the motor housing 114 is an upstanding connector 115 by means of which the cleaner head 100 is connected to the remainder of the vacuum cleaner in a manner which allows the cleaner head 100 to be steered in the way described above. The type of connection which allows this steering to take place does not form the subject matter of this application and so will not be described any further here.

Located behind the cylindrical portion 110 and on either side of the motor housing 114 are two rearwardly extending portions 116, 118. Each rearwardly extending portion 116, 118 is formed by a rearward portion of the upper surface 104 and a rearward portion of the underneath surface 106. The height of each of the rearwardly extending portions 116, 118 is less than half of the height of the cylindrical portion 110, although this proportion is not important and can be varied.

A further improvement in maneuverability can be achieved if the interior side edges 116*b*, 118*b* of the rearward portions 116, 118 are also upwardly curved since, whenever the cleaner head 100 is moved laterally, the interior side edge of the rearward portion on the side of the cleaner head opposite the direction of movement will become the leading edge for that rearward portion.

In the embodiment, it is also envisaged that the lower side edges 114*a*, 114*b* of the motor housing 114 will be upwardly curved so that, whenever the cleaner head 100 is caused to move laterally across a surface to be cleaned, each and every leading edge 106*e*, 114*a*, 118*b*; 106*f*, 114*b*, 116*b* will present a smoothly curved surface to the floor surface being cleaned, irrespective of the direction of the lateral movement. In the event that the cleaner head 100 is shaped so that more than two rearwardly extending portions are provided, each rearwardly extending portion will have upwardly extending side edges which present a smoothly curved surface to the floor surface being cleaned.

Figure 6A:
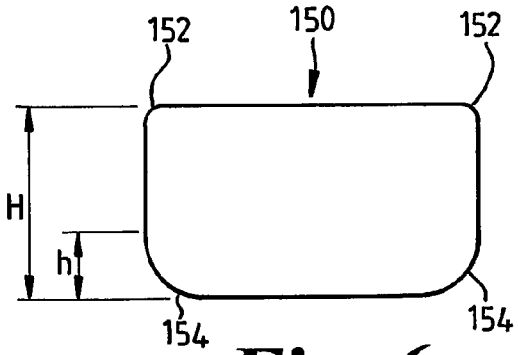
FIGS. 6*a* and 6*b* are rear views, shown on an enlarged scale, of alternative designs of a rear portion of the cleaner head of FIG. 3.
Figure 6B:
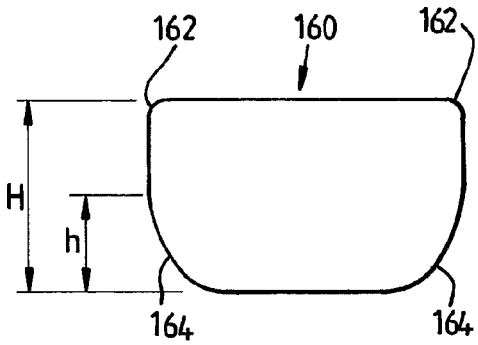

FIGS. 6*a* and 6*b* show rear views of two alternative designs of rearwardly extending portion which could be incorporated into the cleaner head described above. In FIG. 6*a*, the rearwardly extending portion 150 has upper side edges 152 which are relatively sharply defined. However, the lower side edges 154 are upwardly curved, as described above. The extent h of the upwardly curved edges 154 is approximately one third of the total height H of the rearwardly extending portion 150. The alternative design shown in FIG. 6*b* is similar to that shown in FIG. 6*a* in that the rearwardly extending portion 160 has relatively sharply defined upper side edges 162 and smoothly curved lower side edges 164. In this case, though, the extent h of the upwardly curved edges 164 is approximately one half of the total height H of the rearwardly extending portion 160.

Either of the rearwardly extending portions 150, 160 could be incorporated into the cleaner head 100 described above in place of the rearwardly extending portions 116, 118. Furthermore, variations on these designs could equally be utilized. For example, the gaps between the rearwardly extending portions 116, 118 and the motor housing 114 could be omitted so that the rear edge 120 of the housing 102 extends parallel to the front edge of the bumper portion 112. In such an arrangement, only the outermost side edges of the underneath surface 106 will be upwardly curved.

The invention claimed is:

1. A cleaner head for a cleaning appliance, comprising:

a housing having an upper surface and an underneath surface in which at least one suction opening is formed, the underneath surface having opposing side edges each comprising a first part which lies adjacent the suction opening or openings and forms a sharply-defined edge with the upper surface, the sharply defined edge having a first radius of curvature, and a second part which is located rearwardly of the suction opening or openings and is upwardly curved, the upwardly curved side edge of the second part having a radius of curvature substantially larger than the first radius of curvature, and a plurality of rearwardly extending portions, each rearwardly extending portion having opposing side edges which are upwardly curved, the upwardly curved side edges of the rearwardly extending portions having a radius of curvature substantially larger than the first radius of curvature, wherein the first part of each side edge is formed by a lower end of a side wall of the housing, each side wall lower end forming a sharply-defined edge with the suction opening.

2. A cleaner head as claimed in claim 1, wherein the second part of each of the side edges extends along less than one half of the full length of the respective side edge.

3. A cleaner head as claimed in claim 2, wherein one rearwardly extending portion is located at each side of the cleaner head so that one side edge of each rearwardly extending portion forms the second part of each side edge.

4. A cleaner head as claimed in claim 3, wherein the second part of each side edge extends to a height of at least one third of the height of the respective rearwardly extending portion.

5. A cleaner head as claimed in claim 3, wherein the second part of each side edge extends to a height of at least one half of the height of the respective rearwardly extending portion.

6. A cleaner head as claimed in claim 1 or 2, further comprising a brush bar mounted within the housing and adjacent the suction opening.

7. A cleaner head as claimed in claim 1, wherein one rearwardly extending portion is located at each side of the cleaner head so that one side edge of each rearwardly extending portion forms the second part of each side edge.

8. A cleaner head as claimed in claim 7, wherein the second part of each side edge extends to a height of at least one third of the height of the respective rearwardly extending portion.

9. A cleaner head as claimed in claim 7, wherein the second part of each side edge extends to a height of at least one half of the height of the respective rearwardly extending portion.

10. A cleaner head as claimed in claim 1, wherein each side wall is substantially planar.

11. A cleaner head as claimed in claim 1, wherein each side wall lower end forming the sharply-defined edge with the suction opening is substantially linear.

12. A vacuum cleaner comprising:

a cleaner head, comprising:

a housing having an upper surface and an underneath surface in which at least one suction opening is formed, the underneath surface having opposing side edges each comprising a first part which lies adjacent the suction opening or openings and forms a sharply-defined edge with the upper surface, the sharply defined edge having a first radius of curvature, and a second part which is located rearwardly of the suction opening or openings and is upwardly curved, the upwardly curved side edge of the second part having a radius of curvature substantially larger than the first radius of curvature, and a plurality of rearwardly extending portions, each rearwardly extending portion having opposing side edges which are upwardly curved, the upwardly curved side edges of the rearwardly extending portions having a radius of curvature substantially larger than the first radius of curvature, wherein the first part of each side edge is formed by a lower end of a side wall of the housing, each side wall lower end forming a sharply-defined edge with the suction opening, and wherein the upright vacuum cleaner is carried by a rolling support member having an arcuate surface, and wherein the vacuum cleaner is configured such that, when in use the upright vacuum cleaner is caused to turn, the cleaner head travels laterally across the floor surface.

13. A vacuum cleaner as claimed in claim 12, wherein the second part of each of the side edges extends along less than one half of the full length of the respective side edge.

14. A vacuum cleaner as claimed in claim 12 or 13, wherein one rearwardly extending portion is located at each side of the cleaner head so that one side edge of each rearwardly extending portion forms the second part of each side edge.

15. A vacuum cleaner as claimed in claim 14, wherein the second part of each side edge extends to a height of at least one third of the height of the respective rearwardly extending portion.

16. A vacuum cleaner as claimed in claim 14, wherein the second part of each side edge extends to a height of at least one half of the height of the respective rearwardly extending portion.

17. A vacuum cleaner as claimed in claim 12, wherein each side wall is substantially planar.

18. A vacuum cleaner as claimed in claim 12, wherein each side wall lower end forming the sharply-defined edge with the suction opening is substantially linear.

* * * * *